US006071342A

United States Patent [19]

Krebs et al.

[11] Patent Number: 6,071,342

[45] Date of Patent: Jun. 6, 2000

[54] DEVICE FOR APPLYING A FLUID TREATMENT OR DECORATION AGENT

[75] Inventors: Stefan Krebs, Krefeld; Johannes Nolden, Willich, both of Germany

[73] Assignee: Eduard Küsters Maschinenfabrik GmbH & Co. KG, Krefeld, Germany

[21] Appl. No.: 08/817,080

[22] PCT Filed: Aug. 19, 1995

[86] PCT No.: PCT/DE95/01102

§ 371 Date: Jun. 4, 1997

§ 102(e) Date: Jun. 4, 1997

[87] PCT Pub. No.: WO96/11295

PCT Pub. Date: Apr. 18, 1996

[30] Foreign Application Priority Data

Oct. 11, 1994 [DE] Germany ..... 44 36 266

[51] Int. Cl.[7] ..... B05C 3/00

[52] U.S. Cl. ..... 118/424; 118/423

[58] Field of Search ..... 165/166, 167, 165/153; 118/261, 202, DIG. 4, 325, 667, 423, 424; 68/15, 22 B

[56] References Cited

U.S. PATENT DOCUMENTS

| | | | |
|---|---|---|---|
| 1,891,434 | 12/1932 | McKean et al. | 165/166 |
| 2,784,583 | 3/1957 | Dungler | 68/15 |
| 3,255,617 | 6/1966 | Bisang | 68/15 |
| 3,690,297 | 9/1972 | Dentch et al. . | |
| 5,421,884 | 6/1995 | Schafer | 118/202 |

FOREIGN PATENT DOCUMENTS

| | | | |
|---|---|---|---|
| 1460265 | 1/1969 | Germany . | |
| 24 19 611 | 11/1974 | Germany . | |
| 27 43 742 | 3/1979 | Germany . | |
| 37 33 996 | 4/1989 | Germany . | |
| 39 15 844 | 12/1990 | Germany . | |
| 92 01 546 U | 7/1992 | Germany . | |
| 42 03 086 | 5/1993 | Germany . | |
| 478624 | 3/1973 | U.S.S.R. | 118/DIG. 4 |
| 0694223 | 10/1979 | U.S.S.R. | 118/DIG. 4 |
| 406254465 | 9/1994 | U.S.S.R. | 118/DIG. 4 |

*Primary Examiner*—Brenda A. Lamb
*Attorney, Agent, or Firm*—Kenyon & Kenyon

[57] ABSTRACT

Design of a device for application of a fluid treatment to a moving web having the following structural components: a tank through which the web moving in an upwardly direction is passed for impregnation with a treatment liquid; drainage plate assembly having a double-wall structure defining a space therebetween for accommodating flow of a heat carrier; an applicator assembly for applying the treatment liquid onto the top of the drainage plate so that the treatment liquid flows downwardly along the top surface of the drainage plate and onto the web; and means for providing the heat carrier to the space within the drainage plate for adjusting the temperature of the drainage plate thereby affecting the temperature of the treatment liquid being applied to the web.

19 Claims, 3 Drawing Sheets

DEVICE FOR APPLYING A FLUID TREATMENT OR DECORATION AGENT

BACKGROUND OF THE INVENTION

The present invention is directed to the application of a fluid treatment or decoration agent to a continuously moving web. More particularly, it is directed to a device of the type having a drainage plate that spans the width of the web and which is inclined towards the web in a plane generally perpendicular to along or slightly curved with respect to the plane of the web. Such devices include a means for applying the fluid treatment or decoration agent onto the top of the drainage plate. The treatment or decoration agent moves down in a layer corresponding to the drop line above the top of the drainage plate, and gets onto the web from the bottom edge of the drainage plate.

Such devices are known in various variations, such as those which are evident from DE 27 43 742, DE 37 33 996, and DE 39 15 844, for example.

The fluid treatment or decoration agent, for example a dye fluid, moves on the surface of the drainage plate in a thin layer. This thin layer has a relatively large area, at which evaporation takes place, with correspondingly strong cooling of the small amount of fluid mass. Such cooling of the treatment or decoration agent is not desirable, in many cases. In most cases, the treatment or decoration agent has just been brought to an elevated temperature which is the optimum temperature for the treatment effect. As the fluid passes over the drainage plate, this temperature drops in a manner which is difficult to foresee or control.

SUMMARY OF THE INVENTION

The present invention counteracts such temperature decrease by providing a heating device for controlling (i.e., tempering) the temperature of the drainage plate along which the treatment fluid flows so as to thereby control the temperature of that fluid.

Using the heating device, the temperature decrease can be reduced, or, if necessary, a temperature increase of the treatment or decoration agent can even be achieved just before it passes over to the web, depending on how the control provided for is carried out. In this manner, the process can actually be influenced by the temperature control afforded by the instant invention.

In a first embodiment, the heating device can comprise a surface heating element which is connected with the underside of the drainage plate in heat-conductive manner, for example, an electric heating cuff).

In the preferred embodiment of the invention the drainage plate assembly has a double wall, and the space between the walls has a heat carrier medium flowing through it. The flow through this space is along at least two flow paths, in counter-flow, parallel to one another, in order to ensure the most uniform temperature influence possible over the width of the web.

As noted, the drainage plate can be formed of two walls, which lie opposite and parallel to one another. The walls are kept at a distance from and connected with one another by spacer elements. These spacer elements can consist of individual pins, an in particular may take the form of threaded bolts. This is especially suitable where the top surface of the drainage plate is made of sheet metal. The threaded bolts, which have threaded nuts on their exterior, may then be welded onto the sheet metal, and pass through the other of the walls.

According to one alternative embodiment of the invention, heating may be effected via fluid flowing through oppositely arrayed "U" shaped channels located on either side of the web. The channels are bounded by continuous elastic cords that are wound about the pins and which are compressed between the walls to form a seal. By this means flow paths can be formed between the walls, depending on the pattern in which the cord is laid, and these can be sealed towards the outside, in simple manner. The U-shaped flow path consists of two elongated, parallel sides connected by a narrow bridge; the path is set with its longer sides parallel to the web as the connecting bridge is set perpendicular to the web. An inflow port is located at the extremity of one of the long sides, and an outflow port is located at the end of the other. Such a simple pattern provides two flow paths through which flow is possible in counter-flow form.

The pins around which the elastic cords are wound are generally arranged in three parallel rows, extending crosswise with respect to the web. At each of the free ends of the long sides of the U is a pair of pins opposite one another at a distance approximately equal to the pin diameter plus twice the thickness of the cord as measured from the top to the bottom wall. The cord runs on the outside around the outer rows of the pins and loops back internally around the middle row of pins, thereby creating the U-shape.

DETAILED DESCRIPTION

Figure 1:
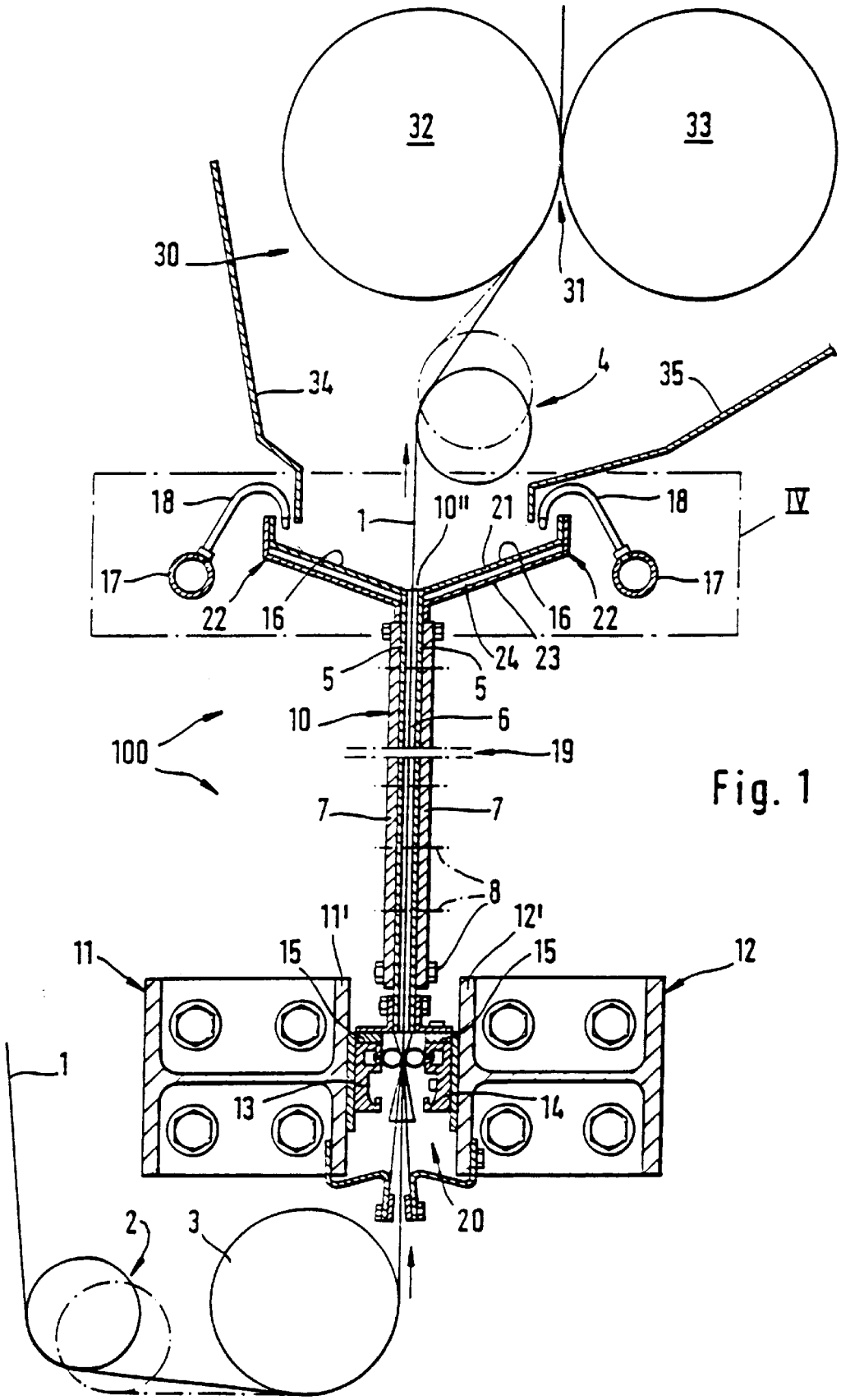
FIG. 1 shows a schematic side view of a first embodiment, partially in cross-section, along a longitudinal plane which is perpendicular to the web.

The application device designated as a whole via reference numeral 100 in the drawing serves to saturate a web 1, for example a textile web, with a treatment fluid. The application device 100 comprises an upright flat channel 10, which can be filled with the treatment fluid, and through which the web 1 passes from the bottom to the top. Towards the bottom, the flat channel 10 is sealed off with a seal arrangement 20, which rests against the web 1 from both sides and prevents the treatment fluid from running out of the flat channel 10, towards the bottom.

Above the flat channel 10, a squeezing unit 30 with two squeezing rollers 32, 33 which work against each other is arranged; the rollers serve to squeeze off the web 1 that has been saturated in the flat channel 10 to a pre-determined moisture content, so that a certain amount of treatment fluid remains on the web 1, in a uniform distribution.

The web 1 runs from the top over a width stretching roller 2 which is arranged below the application device 100, is deflected there by about 90°, and reaches a deflection roller 3 approximately horizontally. From the right side in FIG. 1, the web 1 runs vertically upward and above the flat channel 10, via another width stretching roller 4, and then enters the roller The flat channel 10 consists of two rectangular pieces of sheet metal, which are opposite one another at a slight distance, which form the flat sides 5, 5 of the channel 10. The longer sides of the rectangular pieces of sheet metal are located in the width direction of the web 1. Between the upright shorter sides, a rectangular spacer profile 6 is arranged at the edge, in each instance, with shim profiles 7, 7 opposite them on the outside. The entire thing is connected by means of a series of screws 8, and sealed in suitable manner, so that a channel 10 which is closed in horizontal cross-section is obtained. At the top and the bottom, the flat channel 10 ends in an open manner. At the bottom end of the flat channel 10, a support construction is provided, of which only two I-beams 11, 12, which lie opposite one another at the same height, are shown. The I-beams 11, 12 lie opposite one another at a distance, with a cross-stay 11', 12' in each instance. In the space between the beams, holder pieces 13, 14, 15 are mounted on the cross-stays 11', 12', which hold the bottom end of the flat channel 10 and the seal arrangement 20 in place. If necessary, the flat channel 10 can also be supported at an additional point.

At the top end 10", the plates or pieces of sheet metal which form the flat sides 5, 5 of the flat channel 10 are angled outward, and form drainage surfaces 16 which are angled inward, via which the treatment fluid runs down, at a slant, into the top end of the flat channel 10, in the form of a film or layer. Outside of the drainage surfaces 16, horizontal feed pipes 17 for treatment fluid are provided, which extend parallel to the flat sides 5, 5, are supplied with treatment fluid in suitable manner, and are connected with a plurality of small bent tubes 18 which follow one another in the width direction. Tubes 18 are bent in the form of canes, and reach over the top edge of the drainage surfaces 16. The treatment fluid which is applied to the drainage surfaces 16 at a plurality of rather closely spaced locations, through the small bent tubes 18, flows down over the drainage surfaces 16 and becomes uniform in the process, so that the flat channel 10 can be kept filled in the width direction of the web 1, without significant level differences.

The squeezing rollers 32, 33 are provided above the drainage surfaces 16 and small bent tubes 18, in the region of the footprint of the flat channel 10 with its support arrangement. The treatment fluid squeezed off in the roller nip 31 flows down along the web 1 or drips off. In order to catch this treatment fluid, guide surfaces 34, 35 are provided at both sides of the web 1, which catch any treatment fluid accumulating below and to the sides of the squeezing roller 32, 33, and guide it to drainage surfaces 16, from where it is passed back to the flat channel 10.

The drainage surface 16 is formed on the top of a drainage plate which is designated as a whole as 22, with one each being arranged in a mirror image relative to the web 1. The drainage plate 22 has a double-wall structure, and consists of a top, flat wall 21, the top of which is the drainage surface 16, and another wall 23 arranged at a distance below the former. In the exemplary embodiment, the two walls 21, 23 consist of panels of sheet metal made of corrosion-resistant steel. In principle, the walls 21, 23 can also consist of plastic, but then simple forming by means of bending them at an angle is not possible.

Figure 6:
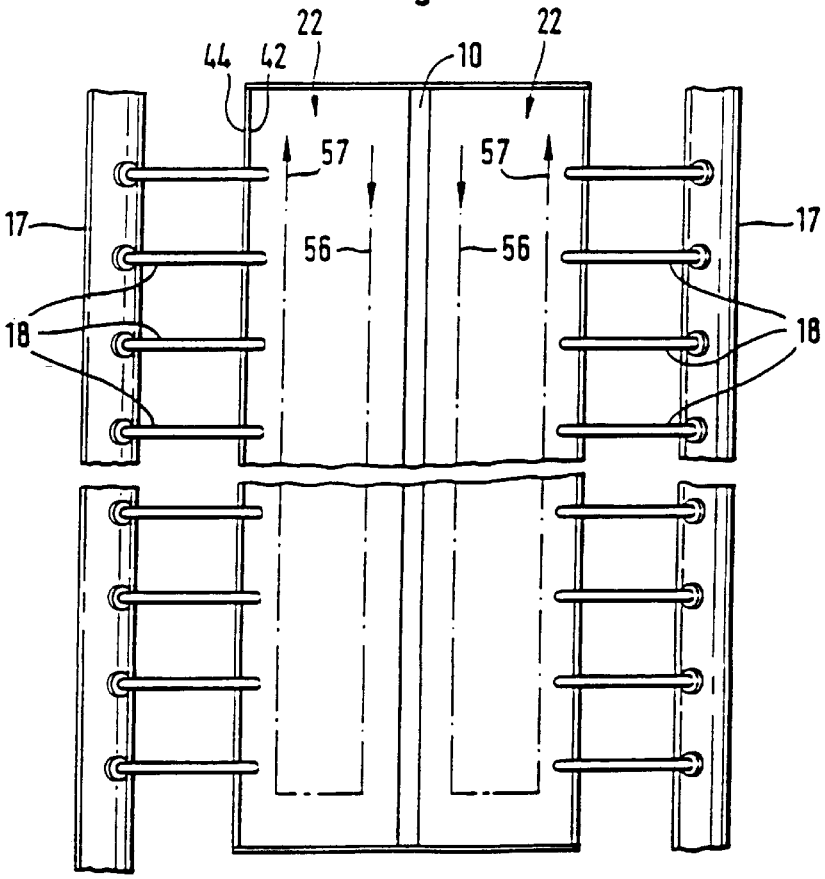
FIG. 6 shows a view according to FIG. 4, from above, on a somewhat smaller scale.

A space 24 is left between the walls 21, 23, through which a heat carrier medium such as hot water, oil, or air can flow. In most cases, the concern is to heat the drainage surface 16. In principle, however, cooling is also possible. The structure of the drainage plate 22 is explained in greater detail using FIG. 4 to 6.

Figure 2:
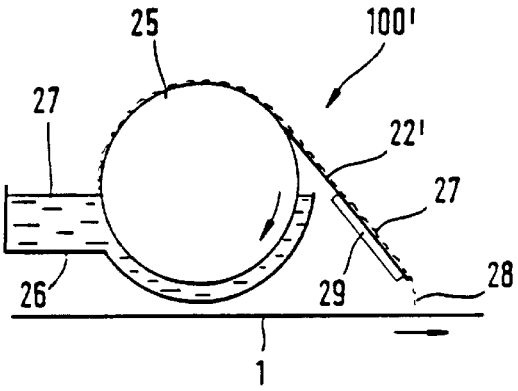
FIG. 2 and 3 schematically show other possible embodiments.

FIG. 2 shows a different drainage plate 22' which can be used for the invention, which rests against a roller 25 which rotates in the direction of the arrow, against the side of the roller which is moving down. The roller 25 dips into a treatment fluid 27 located in a basin 26, with its bottom part, and this fluid is entrained by the roller 25 as it rotates, at the beginning, and stripped from the circumference of the roller 25 by the drainage plate 22'. The treatment fluid 27 moves in a thin layer over the surface of the drainage plate 22' and drops from its horizontal bottom edge in the form of a uniform veil, onto the web 1 which is passing by below it, in the direction of the arrow.

At the bottom of the drainage plate 22', a flat heating element 29 in the form of an electric heating cuff is provided over the width of the web 1, by means of which the drainage plate 22' can be heated.

Figure 3:
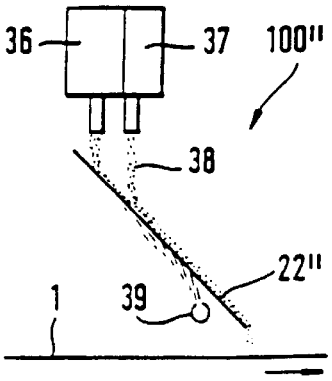

FIG. 3 shows a drainage plate 22", where a dye foam 38 is deposited onto the top region of the plate from several feed devices 36, 37. This foam moves down over the drainage plate 22", which is angled down towards the web 1, and passes over from the bottom, horizontal edge of the plate onto the web 1. In this case, a nozzle tube 39 is provided below the bottom region of the drainage plate 22", from which tube tempered air can be directed against the bottom of the drainage plate 22", so that it can be heated or, if desired, also cooled.

Figure 4:
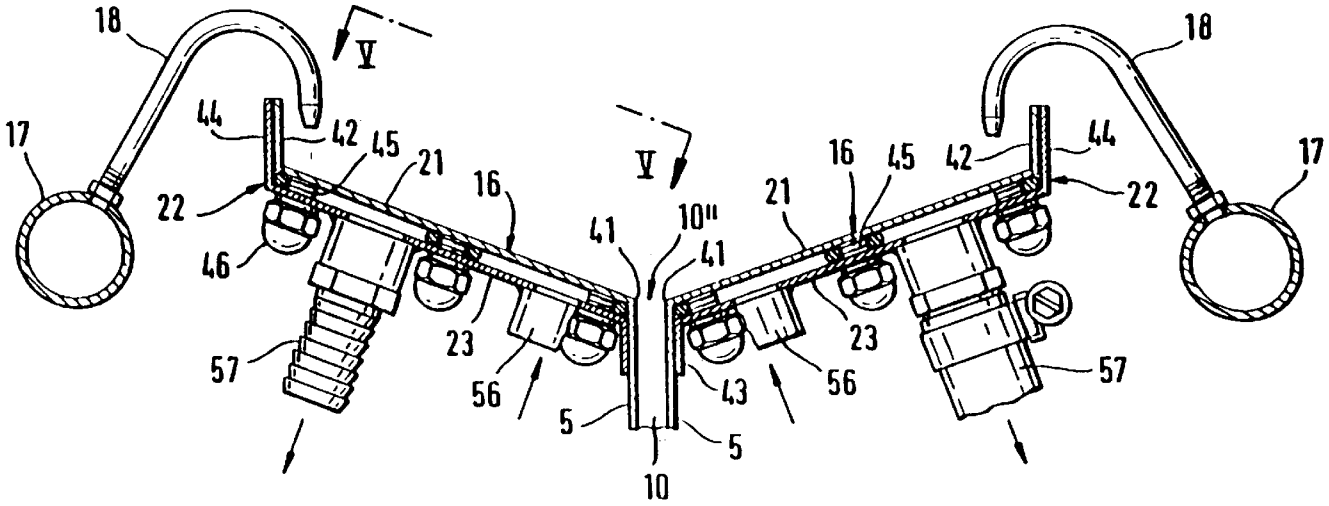
FIG. 4 shows the region outlined with a broken line, indicated as IV in FIG. 1, on an enlarged scale.

FIG. 4 shows the region IV of the drainage plate 22 in FIG. 1, on a larger scale. At the top end 10" of the channel 10, the pieces of sheet metal forming the flat sides 5, 5 are bent outward along a horizontal bending edge 41, rising at an angle of about 20° from the horizontal, and are provided with angled areas 42 directed vertically upward. The angled area which forms the drainage surface 16, i.e. the top wall 21", is flat. Below the top wall 21, a bottom wall 23 is arranged, which runs parallel to the top wall 21 and has an angled area 42 which rests against the flat sides 5, 5, and an angled area 44 which runs vertically upward directly outside the angled area 42, stabilizing the wall 23.

The walls 21, 23 are connected with one another by means of threaded bolts 45 which are welded on, which are welded onto the bottom of the top wall 21, pass through the bottom wall 23, and are provided with cap nuts 46 which are screwed onto the outside.

Figure 5:
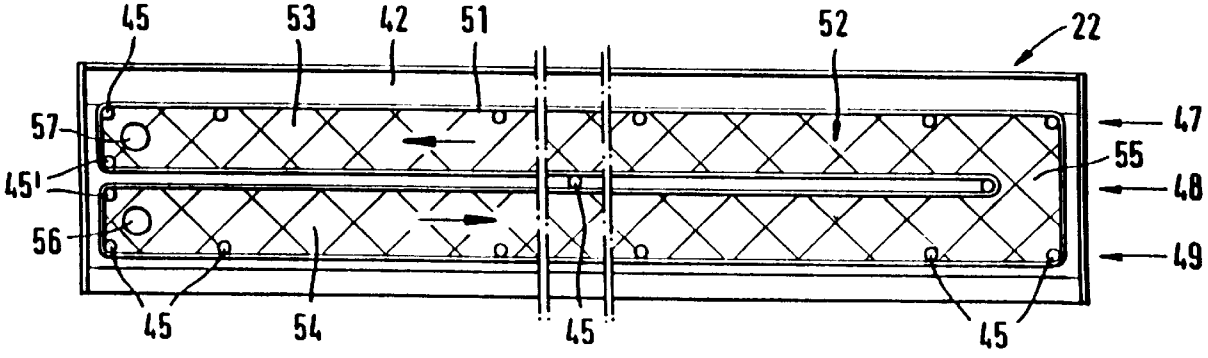
FIG. 5 shows a view according to the Line V—V in FIG. 4, with the upper wall left out.

According to FIG. 5, the threaded bolts 45 which are welded on are arranged in three rows 47, 48, 49 which extend crosswise to the web 1, i.e. parallel to the longer sides of the rectangular drainage plate 22, at the same cross-wise distance from one another. At the left end of the center row 48 in FIG. 5 are two bolts 45", instead of only one welded-on threaded bolt 45 as at the opposite end. The bolts 45" have a crosswise distance from one another which corresponds to the diameter of the threaded bolt 45 plus twice the diameter of a cord 51 of an elastomer material, which is wound around the threaded bolts 45 in endless manner, in the progression which is evident from FIG. 5. The endless cord 51 forms a total flow path, indicated as a whole as 52, and emphasized with cross-hatching, which has the outline of a small and high "U." The shanks 53, 54 of the "U" run crosswise to the web 1 and are connected with the crosspiece 55. The cord 51 runs along the outside of the edges of the shanks 53, 54 and the crosspiece 55. On the outside, it is passed around the outer rows 47, 49 of the threaded bolts 45, and runs between the adjacent threaded bolts 45' towards the inside, on both sides of the center row 48.

The cord 51 is compressed between the walls 21, 23 under the effect of the tightened nuts 46, and thereby seals the total flow path 52 on the sides. At the free ends of the shanks 53, 54, connecting taps 56 for inflow of a heat carrier medium and 57 for its outflow are provided. The heat carrier medium therefore flows in a counter-flow in the flow paths given by the shanks 53, 54, so that uniformity of temperature is achieved. In the preferred exemplary embodiment, the heat carrier medium is water.

What is claimed is:

1. An apparatus for impregnating a continuously moving web with a treatment liquid or decoration agent, comprising:

a tank through which the web is passed for impregnation with treatment liquid as it traverses the tank in an upwardly direction, said tank having an upright channel that serves to contain the treatment liquid as it is passed to the web, the upright channel having flat facing sides which are tightly opposed and configured to extend generally parallel to the web, wherein the upright channel has an upper end and a lower end, the lower end being limited by a resilient sealing arrangement that can be brought to bear on the web from both sides and wherein the upright channel can be kept charged with treatment liquid to a desired level;

a drainage plate assembly having a top surface, a bottom surface, and a bottom edge, said drainage plate being extending across the width of the web and being arranged at an angle with respect to the web, the drainage plate further having a double-wall structure defining a space therebetween for accommodating flow of a heat carrier;

an applicator assembly for applying the treatment liquid onto the top of the drainage plate so that the treatment liquid flows downwardly from the applicator assembly to the drainage plate in a layer along a line from a location above the top surface of the drainage plate along the drainage plate towards the bottom edge of the drainage plate to the web;

a means for providing the heat carrier to the space within the drainage plate for adjusting the temperature of the drainage plate thereby affecting temperature of the treatment liquid being applied to the web; and means for guiding the web through the tank in the upwardly direction.

2. An apparatus as set forth in claim 1, further including at least two flow paths for the introduction of the heat carrier such that the flow paths, viewed crosswise to the web, are parallel to one another and provide a counter-flow.

3. An apparatus as set forth in claim 2, wherein the drainage plate is formed of two rigid walls which lie parallel to one another, and are held at a distance from and connected with one another by means of spacer elements distributed over the surface of the walls.

4. An apparatus as set forth in claim 1, wherein the drainage plate is formed of two rigid walls which lie parallel to one another, and are held at a distance from and connected with one another by means of spacer elements distributed over the surface of the walls.

5. An apparatus as set forth in claim 4, wherein the spacer elements are individual pins.

6. An apparatus as set forth in claim 5, wherein at least one of the walls comprises sheet metal, and the pins are formed as threaded bolts that are welded onto the sheet metal of one of the walls and pass through the other of the walls, said bolts having nuts which bear against the exterior of the other wall.

7. An apparatus as set forth in claim 6, further comprising at least one endless elastic cord, wherein the flow paths are formed by the elastic cord in combination with the walls, the elastic cord being wound around the pins and compressed between the walls to form a seal.

8. An apparatus as set forth in claim 7, wherein the cord defines the outline of a U having elongated sides extending from an extremity at the free ends of the U towards a shorter connecting side, the elongated sides extending parallel to the web, one of the elongated sides having an inflow port at its extremity and the other of the elongated sides having an outflow port at its extremity, the shorter connecting side extending along a line that intersects with the web, such that a flow path is formed comprising a channel extending from the inflow port, across one of the long sides of the U through the connecting side and continuing through the other of the long sides of the U to the outflow port.

9. An apparatus as set forth in claim 8, wherein:

the pins are generally arranged in three parallel rows which extend crosswise to the web;

at the free ends of the elongated sides of the U two pins lie opposite one another at a distance approximately corresponding to the pin diameter plus twice the thickness of the cord as measured parallel to the walls and perpendicular to the shanks of the U; and the cord running on the outside around the outer rows of the pins, between the two pins at the free ends of the U and through the ends of the shanks and on both sides of the pins of the center row.

10. An apparatus for the application of a treatment liquid to a continuously moving web, comprising:

a tank through which the web is passed for impregnation with treatment liquid as it traverses the tank in an upwardly direction, said tank having an upright channel that serves to contain the treatment liquid as it is passed to the web, the upright channel having flat facing sides which are tightly opposed and configured to extend generally parallel to the web, wherein the upright channel has an upper end and a lower end, wherein the upright channel can be kept charged with liquid to a desired level;

a drainage plate assembly having a top surface, a bottom surface, and a bottom edge, said drainage plate extending across the width of the web and being arranged at an angle with respect to the web, the drainage plate further having a double-wall structure defining a space therebetween for accommodating the flow of a heat carrier;

an applicator assembly for applying the treatment liquid onto the top of the drainage plate so that the treatment liquid flows downwardly from the applicator assembly to the drainage plate in a layer from a position above the top surface of the drainage plate along the drainage plate towards the bottom edge of the drainage plate to the web, and means for guiding the web through the tank in the upwardly direction; and means for guiding the web through the tank in the upwardly direction, wherein the space accomodates for flow of a heat carrier therein thereby affecting the temperature of the top surface of the drainage plate and the temperature of the treatment liquid being applied to the web.

11. An apparatus as set forth in claim 10, further including first and second flow paths on either side of the web for the introduction of the heat carrier, the flow paths each providing path segments that run counter-current to one another.

12. An apparatus as set forth in claim 11, wherein the drainage plate is formed of two rigid walls which lie parallel to one another, and are held at a distance from and connected with one another by means of spacer elements distributed over the surface of the walls.

13. An apparatus as set forth in claim 12, wherein the spacer elements are individual pins.

14. An apparatus as set forth in claim 13, wherein at least one of the walls is made of sheet metal, and the spacer elements are threaded bolts that are welded onto the sheet metal of one of the walls and pass through the other of the walls, said bolts having nuts which bear against the exterior of the wall to which the bolts are not welded.

15. An apparatus as set forth in claim 12, further comprising an elastic belt that is entrained by the spacer elements to define the flow channel for the heat carrier therebetween.

16. An apparatus as set forth in claim 15, wherein the flow channel has two long parallel sides terminating in free ends and being linked to one another by a short side.

17. An apparatus as set forth in claim 16, further comprising an inlet port at the free end of one of the long sides of the flow channel and an outlet port at the free end of the other of the long sides of the flow channel.

18. An apparatus as set forth in claim 17, wherein the spacer elements are arranged along three parallel rows comprising two exterior rows and a middle interior row, wherein the belt runs along the exterior rows and loops back along the interior row to define a U-shaped flow channel.

19. An apparatus as set forth in claim 18, wherein the belt is compressed between the walls to form a seal therewith.

* * * * *

UNITED STATES PATENT AND TRADEMARK OFFICE

CERTIFICATE OF CORRECTION

PATENT No. : 6,071,342

DATED : June 6, 2000

INVENTOR(S): KREBS et al.

It is certified that error appears in the above-identified patent and that said Letters Patent is hereby corrected as shown below:

Column 6, line 50, after "the web" delete ", and means for guiding the web through the tank in the upwardly direction".

Signed and Sealed this

Seventeenth Day of April, 2001

*Attest:*

Nicholas P. Godici

NICHOLAS P. GODICI

*Attesting Officer*

*Acting Director of the United States Patent and Trademark Office*